US012085094B2

(12) United States Patent
Hauge

(10) Patent No.: US 12,085,094 B2
(45) Date of Patent: Sep. 10, 2024

(54) PRESSURE EXCHANGER WITH FLOW DIVIDER IN ROTOR DUCT

(71) Applicant: ISOBARIC STRATEGIES INC., Riverside, CA (US)

(72) Inventor: Leif J. Hauge, Beaumont, CA (US)

(73) Assignee: Isobaric Strategies Inc., Riverside, CA (US)

( * ) Notice: Subject to any disclaimer, the term of this patent is extended or adjusted under 35 U.S.C. 154(b) by 303 days.

(21) Appl. No.: 17/170,087

(22) Filed: Feb. 8, 2021

(65) Prior Publication Data

US 2021/0246910 A1 Aug. 12, 2021

Related U.S. Application Data

(60) Provisional application No. 62/975,585, filed on Feb. 12, 2020.

(51) Int. Cl.
*F04F 13/00* (2009.01)

(52) U.S. Cl.
CPC ..... *F04F 13/00* (2013.01)

(58) Field of Classification Search
CPC ..... B01D 53/1425; B01D 53/18; C10L 3/103; C10L 3/104; C10L 2290/541; F04B 9/00; F04F 13/00; F15B 3/00
USPC ..... 417/66
See application file for complete search history.

(56) References Cited

U.S. PATENT DOCUMENTS

| | | | | |
|---|---|---|---|---|
| 2,675,173 A * | 4/1954 | Jendrasski | ..... | F04F 13/00 417/225 |
| 2,898,866 A | 8/1959 | Deackoff | | |
| 3,095,704 A | 7/1963 | Brian | | |
| 3,145,909 A | 8/1964 | Gardiner | | |
| 3,234,736 A | 2/1966 | Brian | | |
| 3,874,166 A | 4/1975 | Kirchhofer et al. | | |
| 4,352,638 A * | 10/1982 | Vallance | ..... | F04F 13/00 417/64 |
| 5,338,158 A | 8/1994 | Hauge | | |

(Continued)

FOREIGN PATENT DOCUMENTS

| | | |
|---|---|---|
| CN | 101440828 | 5/2009 |
| CN | 101568733 | 10/2009 |

(Continued)

OTHER PUBLICATIONS

International Preliminary Report on Patentability in International Appln. No. PCT/US2021/018003, dated Mar. 23, 2022, 5 pages.

(Continued)

*Primary Examiner* — Woody A Lee, Jr.
*Assistant Examiner* — Justin A Pruitt
(74) *Attorney, Agent, or Firm* — Fish & Richardson P.C.

(57) ABSTRACT

A pressure exchanger includes a rotor including rotor ducts that extend parallel to each other. The pressure exchanger further includes a flow divider that has a substantially flat shape and is located in the rotor ducts, where the flow divider partitions an inner space of one of the rotor ducts into flow paths configured to communicate fluid. The flow divider defines an aspect ratio of each of the plurality of flow paths, where the aspect ratio is a ratio of a width of one of the flow paths in a radial direction with respect to an axial length of one of the flow paths in the axial direction.

20 Claims, 5 Drawing Sheets

(56) References Cited

U.S. PATENT DOCUMENTS

| | | | | |
|---|---|---|---|---|
| 5,522,217 | A | 6/1996 | Zauner | |
| 5,988,993 | A * | 11/1999 | Hauge | F04F 13/00 417/365 |
| 6,460,342 | B1 * | 10/2002 | Nalim | F23R 3/56 60/39.45 |
| 6,544,492 | B1 | 4/2003 | DeBerry | |
| 6,725,881 | B1 * | 4/2004 | Beswick | F16K 11/0743 137/625.21 |
| 7,938,627 | B2 * | 5/2011 | Muller | F04D 29/023 416/198 A |
| 7,997,853 | B2 | 8/2011 | Pique et al. | |
| 8,226,376 | B2 * | 7/2012 | Krosgsgard | F04F 13/00 417/66 |
| 9,440,895 | B2 | 9/2016 | Arluck et al. | |
| 9,546,671 | B2 | 1/2017 | Hirosawa et al. | |
| 9,604,889 | B2 | 3/2017 | Arluck et al. | |
| 9,945,216 | B2 | 4/2018 | Ghasripoor et al. | |
| 10,125,594 | B2 | 11/2018 | Lewis et al. | |
| 10,125,796 | B2 | 11/2018 | Hauge | |
| 10,138,907 | B2 * | 11/2018 | Pinto | F04F 99/00 |
| 10,900,318 | B2 | 1/2021 | Lewis et al. | |
| 10,961,823 | B2 | 3/2021 | Shampine | |
| 11,157,025 | B2 | 10/2021 | Shampine | |
| 11,572,899 | B2 | 2/2023 | Hauge | |
| 2006/0037895 | A1 | 2/2006 | Shumway | |
| 2009/0104046 | A1 | 4/2009 | Martin | |
| 2010/0196152 | A1 | 8/2010 | Pique et al. | |
| 2013/0037008 | A1 * | 2/2013 | Takamiya | F02B 33/42 417/64 |
| 2013/0121850 | A1 | 5/2013 | Pinto et al. | |
| 2014/0128656 | A1 | 5/2014 | Arluck et al. | |
| 2015/0096739 | A1 | 4/2015 | Ghasripoor et al. | |
| 2016/0160890 | A1 | 6/2016 | Anderson | |
| 2016/0222985 | A1 | 8/2016 | Oklejas, Jr. | |
| 2017/0130743 | A1 | 5/2017 | Anderson | |
| 2017/0335668 | A1 | 11/2017 | Ghasripoor et al. | |
| 2017/0350428 | A1 | 12/2017 | Martin et al. | |
| 2019/0055805 | A1 | 2/2019 | Lewis et al. | |
| 2019/0278306 | A1 | 9/2019 | Shampine | |
| 2019/0390576 | A1 | 12/2019 | Thatte | |
| 2020/0149556 | A1 | 5/2020 | Judge et al. | |
| 2021/0246912 | A1 | 8/2021 | Hauge | |
| 2021/0254636 | A1 | 8/2021 | Hauge | |

FOREIGN PATENT DOCUMENTS

| | | |
|---|---|---|
| EA | 2575 | 6/2002 |
| GB | 840408 | 7/1960 |
| JP | 2011231634 | 11/2011 |
| RU | 2659646 | 7/2018 |
| SU | 1642096 | 4/1991 |

OTHER PUBLICATIONS

International Search Report and Written Opinion in International Appln. No. PCT/US2021/018003, dated Apr. 28, 2021, 20 pages.
International Search Report and Written Opinion in International Appln. No. PCT/US2021/018010, dated May 7, 2021, 18 pages.
International Search Report and Written Opinion in International Appln. No. PCT/US2021/018012, dated Apr. 6, 2021, 14 pages.
International Preliminary Report on Patentability in International Appln. No. PCT/US2021/018012, dated Aug. 25, 2022, 9 pages.
International Preliminary Report on Patentability in International Appln. No. PCT/US2021/018010, dated Aug. 25, 2022, 10 pages.
RU Office Action in Russian Appln. No. 2022123957/12, dated Apr. 28, 2023, 15 pages (with English translation).
CN Office Action in Chinese Appln. No. 202180014563.4, dated Sep. 29, 2023, 22 pages (with English translation).

* cited by examiner

RELATED ART

PRESSURE EXCHANGER WITH FLOW DIVIDER IN ROTOR DUCT

CROSS-REFERENCE TO RELATED APPLICATION

This application claims priority to U.S. Provisional Patent Application No. 62/975,585, filed on Feb. 12, 2020, the disclosures of which are incorporated herein by reference.

TECHNICAL FIELD

The present disclosure relates to a pressure exchanger, and more specifically, a pressure exchanger including one or more flow dividers in rotor ducts to reduce a dead volume in the rotor and increase flow capacity of the pressure exchanger.

BACKGROUND

A pressure exchanger is a device that can exchange pressure energy between a high-pressure fluid stream and a low-pressure fluid stream. For instance, the pressure exchanger can exchange pressure energy between the high pressure fluid stream and the low pressure fluid stream while separating the two fluid streams by a liquid barrier or interface formed in a rotor of the pressure exchanger. The liquid barrier or interface may be defined by a fluid volume remaining in the duct of the rotor (i.e., dead volume) of one or both of the streams. The pressure exchanger may use the remaining dead volume in the rotor as the separating interface or barrier to avoid excessive mixing of the two fluid streams in the rotor. However, in some cases, the dead volume may result in partial displacement of the fluid streams with respect to an entire duct volume, and decrease a flow capacity, i.e., a net output of the pressure exchanger. For instance, a pressure exchanger having a 40% dead volume in the rotor may be able to use only 60% of the duct volume as a displacement volume for transmitting the streams.

In some cases, a pressure exchanger includes a rotor having co-axial ducts in which each stream is displaced by direct contact. In order to prevent excessive mixing of the streams inside the duct, a significant portion of the duct volume may be left as a separation barrier or dead volume. In some cases, this barrier fluid volume may occupy up to 50% of the duct volume, and the dead volume hence causes a substantial reduction of flow capacity per each rotor duct revolution and increases kinetic loss associated with the dead volume of liquid streams.

The dead volume of the rotor generally relates to an aspect ratio ("AR") of the rotor duct, for example, defined by a ratio of a diameter of the rotor duct with respect to a length of the rotor between end surfaces of the rotor. The aspect ratio of the rotor duct also relates to mixing of fluid streams in the rotor. For example, the dead volume and mixing in the rotor duct can be reduced by decreasing the aspect ratio of the rotor duct. Thus, in some cases, for decreasing the capacity loss due to the dead volume, a greater number of rotor ducts with a reduced aspect ratio may be defined in the rotor. However, this approach may result in a limited improvement due to a substantial loss of flow cross-sectional areas. In some cases, the aspect ratio can be reduced by increasing the rotor length, but this approach may not be feasible in general due to manufacturing and bearing performance issues.

In some cases, the rotor may be machined from a single ceramic blank and positioned between end covers that introduce the fluid streams into the rotor ducts. The pressure exchanger may further include tubular elements to improve serviceability, flow pressure ripples, manufacturability, and flow capacity with reduced mixing. For example, the pressure exchanger may include a bundle of tubes disposed between an outer and inner casings. The tubes may be made of metal or composite materials and welded or glued together. The tubes may have a length equal to a length of the rotor and face a sealing element in each end against the end covers. For example, a ceramic sealing element may be used for the rotor made of ceramic. In some cases, where one component is made of metal while the other component made of ceramic, there may be issues with seizure or galling that prevent reliable operation, as well as the unpredictable onset of corrosion.

In some cases, the tubes may be made of alternative materials such as composite materials. The composite materials, however, may wear rapidly by particles in the end clearance with the end covers. In some cases, an epoxy adhesive may be used to attach the tubes made of ceramic to the rotor, but the adhesive may be prone to wear at each end and lead to seal destruction from cavitation. In some cases, the pressure exchanger may include rotor end plates that are glued to the tubes, but the rotor end plates may reduce an available flow cross-sectional area and be very costly to manufacture.

In some cases, a rotor may include a shell or body in the form of an outer tubular casing, and a plurality of walls that radially extend and divide an annular region into a plurality of pie-shaped ducts. For instance, each of the compartments or ducts may include an about 30° segment of the circular cross-section of the rotor. The rotor may further include a plurality of individual tubes that have various sizes and that are spatially arranged in each of the pie-shaped compartments in a repetitive pattern about the rotor. The tubes have varying diameters and occupy a high percentage of the pie-shaped region. This arrangement of the tubes may result in unequal flow resistance and uneven fluid displacement for each rotor duct because the flow velocity may be much higher in the larger tubes than in the smaller tubes. That is, the smaller tubes may be under-utilized, and the concept of having tubular elements may be counterproductive with respect to mixing.

In some cases, pressure exchangers may employ a rotor of solid ceramic or other material, and the rotor may have open ducts of generally circular to pie-shaped cross sections extending longitudinally therethrough. In some examples, the rotational speed of the rotor and the flow of the fluid streams may determine the relative size of the separating dead volume. In some cases, the rotor having a plurality of parallel tubes may suffer from wear, corrosion, and undesired consequences limiting commercial applicability.

SUMMARY

The present disclosure describes a pressure exchanger including one or more flow dividers that are located inside a rotor duct and that can reduce a dead volume and fluid mixing in the rotor duct.

The present disclosure also describes a method for improving the performance of a rotary pressure exchanger to transmit pressure from one fluid stream to another fluid stream.

The present disclosure further describes a pressure exchanger that can improve commercial performance by adding an internal flow divider structure to the rotor ducts. The flow divider can substantially reduce the aspect ratio of the rotor duct without incorporating any element of sealing or structural support function. For example, the internal rotor duct flow divider can split the rotor duct into multiple equal resistance flow elements (e.g., paths or spaces). The flow elements, which have a smaller aspect ratio compared to the original duct without the flow divider, can reduce mixing in the rotor and increase the flow capacity of the pressure exchanger.

In some examples, the flow divider can be press-fitted into the rotor duct. Alternatively or in addition, the flow divider can be glued to the rotor duct. In some examples, the flow divider can have a thin plate structure that may not provide structural support to the rotor. In some examples, the flow divider can be made of various materials that may be different from a material of the rotor. For instance, the flow divider can be made of plastics and provide minimum flow resistance by having thin walls. In some cases, a length of the flow divider can be shorter than a length of the rotor duct to avoid or reduce a mechanical drag and interference between the flow divider and an end cover of the pressure exchanger.

According to one aspect of the subject matter described in this application, a pressure exchanger includes a rotor that is configured to rotate about an axis and that defines a plurality of rotor ducts extending parallel to the axis, where each rotor duct extending between a first side surface and a second side surface of the rotor that are spaced apart from each other in an axial direction. The rotor is configured to communicate a first fluid through the first side surface of the rotor and to communicate a second fluid through the second side surface of the rotor. The pressure exchanger further includes a flow divider that has a substantially flat shape and that is located in one or more of the plurality of rotor ducts, where the flow divider partitions an inner space of one of the plurality of rotor ducts into a plurality of flow paths that are configured to communicate at least one of the first fluid or the second fluid. The flow divider defines an aspect ratio of each of the plurality of flow paths, where the aspect ratio is a ratio of a width of one of the plurality of flow paths in a radial direction with respect to an axial length of the one of the plurality of flow paths in the axial direction.

Implementations according to this aspect can include one or more of the following features. For example, each of the plurality of flow paths can have an equal aspect ratio. In some examples, each of the plurality of flow paths can have an equal cross-sectional area. In some examples, each of the plurality of flow paths can have the same width and the same axial length. In some implementations, an axial length of the flow divider is less than a rotor length of the rotor in the axial direction. In some examples, the rotor length can be greater than the axial length of each of the plurality of flow paths in the axial direction.

The flow divider can include a first axial end surface that is spaced apart from and recessed relative to the first side surface of the rotor in the axial direction, and a second axial end surface that is spaced apart from and recessed relative to the second side surface of the rotor in the axial direction.

In some implementations, the pressure exchanger can further include a plurality of flow dividers including the flow divider, where the plurality of flow dividers are located inside the plurality of rotor ducts, respectively. In some examples, the plurality of flow dividers can include a first and second flow dividers that are located inside the one of the plurality of rotor ducts and that define three or more flow paths in the one of the plurality of rotor ducts. In some examples, the first flow divider can include a first plate, and the second flow divider can include a second plate that intersects the first plate.

In some examples, a radial width of each of the first plate and the second plate is less than or equal to a diameter of the one of the plurality of rotor ducts, where an axial length of each of the first plate and the second plate can be equal to the axial length of the plurality of flow paths in the axial direction. In some implementations, the plurality of flow dividers can further include a third flow divider located inside the one of the plurality of rotor ducts, the third flow divider including a third plate that intersects the first flow divider and the second flow divider. A radial width of the third plate and the radial width of each of the first plate and the second plate are equal to a radius of the one of the plurality of rotor ducts.

In some implementations, the one of the plurality of rotor ducts can include a step portion defined in the one of the plurality of rotor ducts, a first rotor portion that extends from the first side surface of the rotor to the step portion, and a second rotor portion that extends from the second side surface of the rotor to the step portion, where the flow divider is one of a plurality of flow dividers that are located in the first rotor portion and the second rotor portion.

In some implementations, the plurality of flow dividers can include a first flow divider that is located in and extends along the first rotor portion, the first flow divider having a first inner end that faces the step portion, and a second flow divider that is located in and extends along the second rotor portion, the second flow divider having a second inner end that faces the first inner end and the step portion. In some examples, the aspect ratio is defined by a width of the first flow divider or the second flow divider in the radial direction with respect to a sum of axial lengths of the first flow divider and the second flow divider. In some examples, the width of the first flow divider can be different from the width of the second flow divider, and the axial length of the first flow divider is different from the axial length of the second flow divider.

In some implementations, the rotor can be made of ceramic, and the flow divider can be made of a plastic material, where the flow diver can be in contact with the one of the plurality of rotor ducts. In some examples, the flow divider can be coupled to an inner surface of the one of the plurality of rotor ducts by friction without an adhesive. In some examples, the flow divider is coupled to an inner surface of the one of the plurality of rotor ducts by friction and with an adhesive.

In some implementations, the pressure exchanger can further include (i) a first end cover located at the first side surface of the rotor, where the first end cover defines a first pair of apertures configured to communicate the first fluid, and (ii) a second end cover located at the second side surface of the rotor, where the second end cover defines a second pair of apertures configured to communicate the second fluid having. The flow divider can include a first end that faces the first end cover and is spaced apart from the first end cover in the axial direction, and a second end that faces the second end cover and is spaced apart from the second end cover in the axial direction.

In some implementations, a duct length of each of the plurality of rotor ducts in the axial direction can be greater than the axial length of the plurality of flow paths.

BRIEF DESCRIPTION OF THE DRAWINGS

Like reference symbols in the various drawings indicate like elements.

DETAILED DESCRIPTION

One or more implementations of the present disclosure will be described below. These described implementations are only exemplary of the present disclosure. As discussed in detail below, the described implementations relate generally to a rotary pressure exchanger including a plurality of rotor ducts defined in a rotor.

The present disclosure describes one or more examples of flow dividers that are located inside the rotor duct to reduce a dead volume in the rotor of the pressure exchanger and to increase flow capacity of the pressure exchanger.

Figure 1:
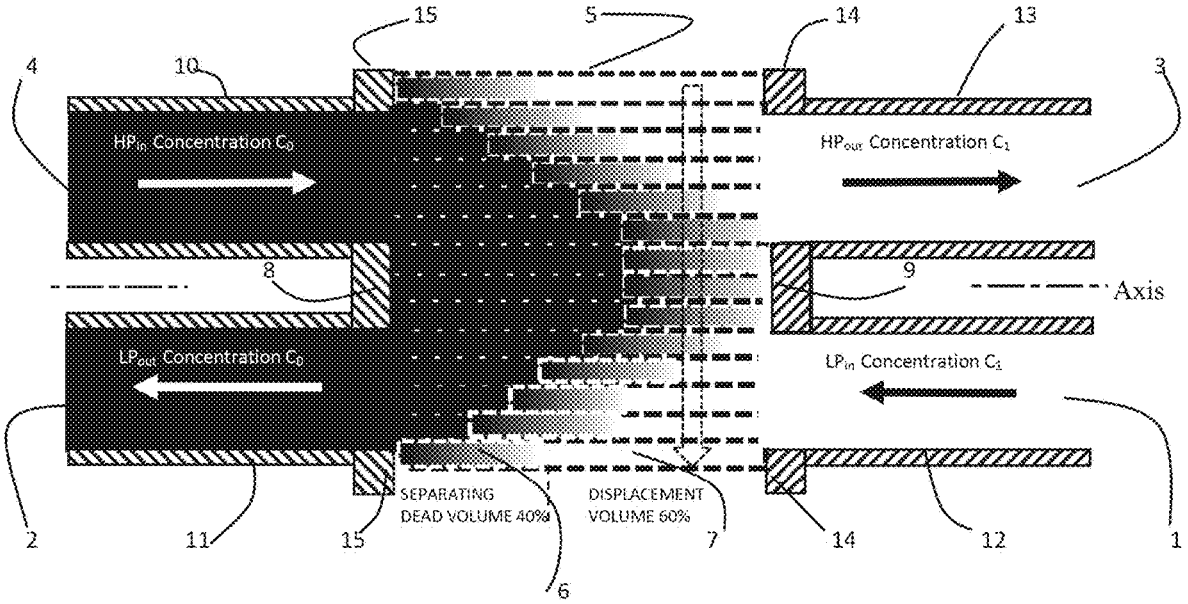
FIG. 1 is a circular cross-sectional view showing an example of a pressure exchanger in related art.

FIG. 1 is a circular cross-sectional view showing an example of operation of a pressure exchanger in related art.

For instance, the pressure exchanger includes a rotor 5 located between a pair of end covers 14 and 15 that face high-pressure streams and low-pressure streams. The end covers 14 and 15 include sealing areas 8 and 9 that are disposed at central areas of the end covers, respectively. The rotor 5 may include multiple rotor ducts that extend through an inside of the rotor 5. The rotor 5 may be located between the high-pressure and low-pressure streams and configured to rotate about an axis passing through the sealing areas 8 and 9.

The end cover 14 may define a plurality of apertures connected to an inlet duct 12 and an outlet duct 13. For example, the end cover 14 includes a first aperture connected to the inlet duct 12 and configured to receive a low pressure seawater feed 1 having $C_1$ salinity (i.e., concentration of salt), and a second aperture connected to the outlet duct 13 and configured to discharge a high pressure seawater output 3 having $C_1$ salinity.

The end cover 15 may define a plurality of apertures connected to an inlet duct 10 and an outlet duct 11. For example, the end cover 15 includes a first aperture connected to the inlet duct 10 and configured to receive a high pressure brine feed 4 having $C_0$ salinity, and a second aperture connected to the outlet duct 11 and configured to discharge a low pressure brine water output 2 having $C_0$ salinity. The salinity ($C_0$) of the brine water feed 4 may be greater than the salinity ($C_1$) of the seawater feed 1.

The seawater feed 1 may, while moving in a direction from the sealing area 9 toward the end cover 15, gradually move a dead volume 6 in the rotor 5 toward the end cover 15. For example, the dead volume 6 may constitute about 40% of an overall duct volume of the rotor 5 and remain in the rotor 5. Based on rotation of the rotor 5, the dead volume 6 may, while moving toward the end cover 15, displace the brine volume 7 in the rotor 5 through the low pressure outlet duct 11. The displacement volume may constitute about 60% of the overall duct volume.

As shown in FIG. 1, the dead volume 6 may separate the different streams and remain in the rotor ducts, while oscillating back and forth along the axis of the rotor 5 for each revolution of the rotor 5. For example, the dead volume may separate the seawater feed 1 and the brine water output 2, and separate the brine water feed 4 and seawater output 3. The dead volume 6 may define a salinity gradient having salinity $C_0$ at the brine interface of the dead volume and salinity $C_1$ at the seawater interface of the dead volume. For example, FIG. 1 illustrates a plurality of portions of the dead volume 6 in the rotor ducts in gray scale. The dead volume 6 may secure a low mixing transfer between brine water and seawater.

Figure 2:
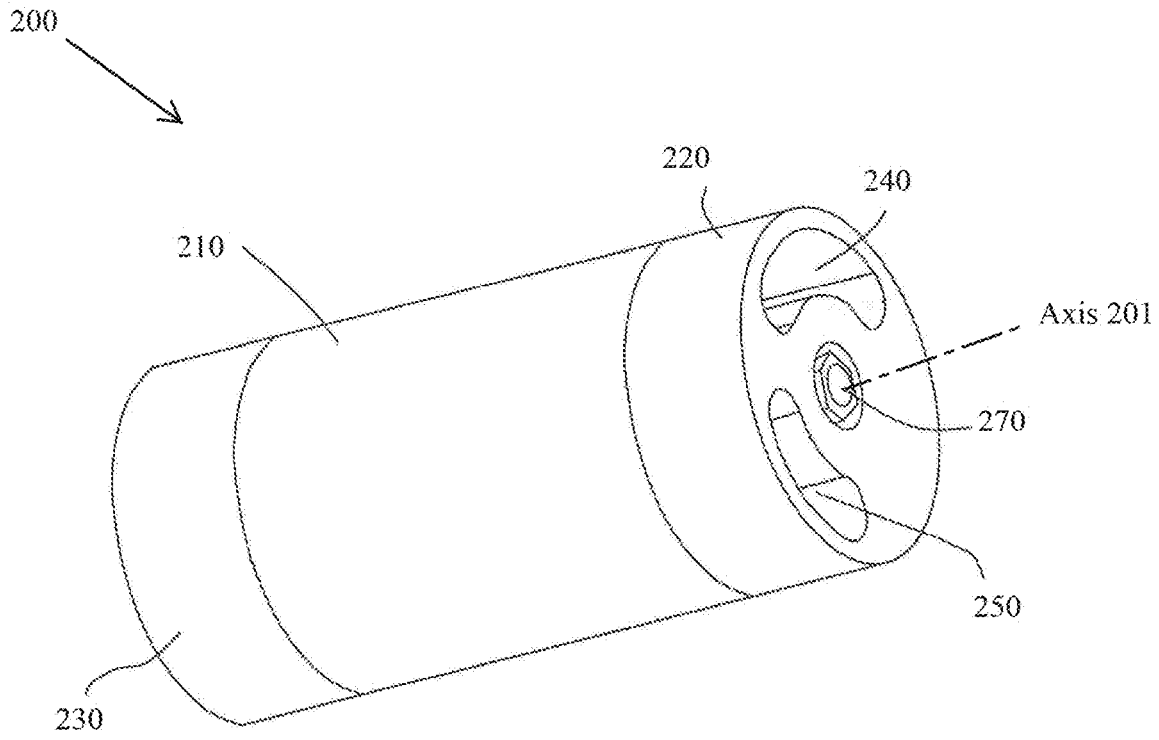
FIG. 2 is a perspective view showing an example of a pressure exchanger according to the present disclosure.

FIG. 2 is a perspective view showing an example of a pressure exchanger according to the present disclosure.

In some implementations, a pressure exchanger 200 can include a rotor 210, a first end cover 220, and a second end cover 230. The first end cover 220 comprises at least one high pressure inlet 240 configured to receive a first stream of high pressure liquid. The first stream can have a first concentration. The first end cover 220 can further include at least one low pressure outlet 250 through which the first stream flows out of the pressure exchanger 200. In some cases, the pressure exchanger 200 can include a rod 270 that holds the rotor 210 and end covers 220 and 230 together. The rod 270 may include or serve as a shaft that defines an axis 201 of rotation of the rotor 210. For instance, the rotor 210 can rotate about the axis 201 in one or both of a clockwise direction and a counterclockwise direction. The rotor 210 and the end covers 220 and 230 can communicate first fluid and second fluid, which is similar to the operation of the rotor 5 and the end covers 14 and 15 described above with FIG. 1.

The rotor 210 can rotate relative to the end covers 220 and 230 by various driving mechanisms. For example, the rotor 210 may mechanically rotate about a shaft (e.g., rod 270) that extends along the axis 201. The shaft may be rotated by a driving device such as a motor. In some implementations, the rotor 210 (or the shaft of the rotor 210) can be configured to rotate by a flow entering to the rotor 210. For instance, the pressure exchanger 200 can further include a ramp structure that includes an inclined surface with respect to the axis 201. The inclined surface of the ramp structure can be configured to face and contact incoming flow streams. Based on pressure of the incoming flow streams applied to the inclined surface of the ramp structure, the rotor 210 can rotate about the shaft relative to the end covers 220 and 230.

In some implementations, a rotation speed of the rotor 210 can be determined based on the arrangement of the incline surface of the ramp structure. For example, the rotation speed of the rotor 210 may be determined based on increasing or decreasing an inclined angle of the incline surface with respect to the axis 201. In some examples, the rotation speed of the rotor 210 may be determined based on increasing or decreasing an area or a number of the incline surfaces arranged in the ramp structure. In some examples, the rotation speed of the rotor 210 may vary based on a pattern of the inclined surface of the ramp structure.

Alternatively or in addition, the rotation speed of the rotor 210 can be controlled by adjusting a flow rate or pressure of the incoming streams. For example, the rotation speed of the rotor 210 can be increased based on an increase of the flow rate of the incoming stream to the end cover 220. The rotation speed of the rotor 210 can be decreased based on a decrease of the flow rate of the incoming stream to the end cover 220. In this example, the rotation speed of the rotor 210 depends on the flow rate of the incoming stream to the end cover 220.

In some implementations, the rotation speed of the rotor 210 can be controlled independent of the flow rate of the incoming stream. For example, the rotor 210 can be rotated by a separate driving device such as a motor. In another example, one or more components of the pressure exchanger 200 may be replaced to adjust the rotation speed of the rotor 210 while keeping the same flow rate of the incoming stream. In particular, the end cover 220, the end cover 230, rotor 210, or the ramp structure having the inclined surface can be replaced to adjust the rotation speed of the rotor 210. In some examples, the end cover 220 and the end cover 230 may include the ramp structure having the inclined surface.

In some implementations, the rotor 210, the end covers 220 and 230, and the rod 270 or another axle may be made of a corrosion resistant material, such as ceramic. For example, the end covers, rotor, and/or axle may be made of Alumina ceramic (aluminum oxide ceramic), including 92% to 99.8% aluminum oxide ceramic, for example. In some cases, the end covers, rotor, and/or axle may be made of Alumina ceramic including 99.8% aluminum oxide ceramic.

Figure 3:
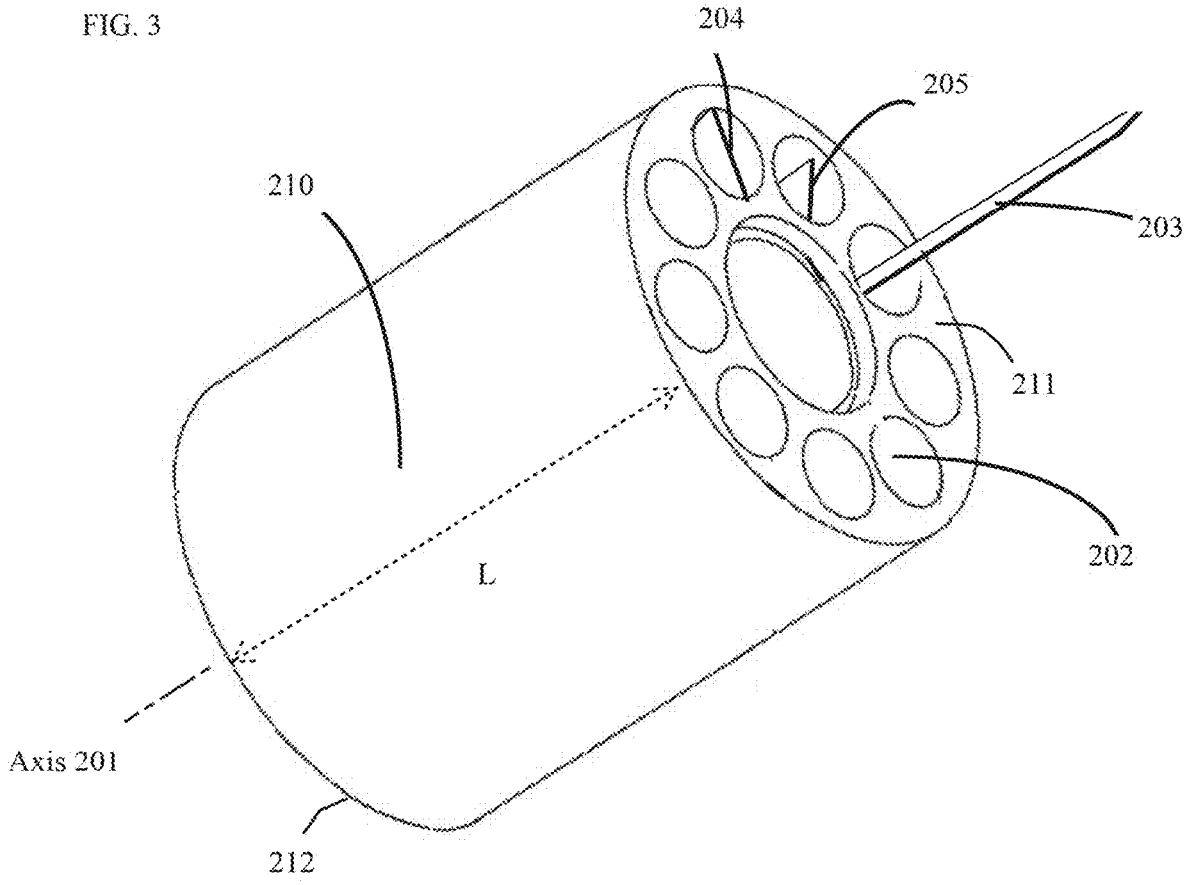
FIG. 3 is a perspective view showing an example of a rotor of the pressure exchanger and examples of flow dividers according to the present disclosure.

FIG. 3 is a perspective view showing an example of a rotor of the pressure exchanger and examples of flow dividers.

For example, the rotor 210 can includes multiple rotor ducts 202 that extend parallel to the axis 201, where each rotor duct 202 extends between a first side surface 211 and a second side surface 212 of the rotor 210. The first side surface 211 and the second side surface 212 are spaced apart from each other in an axial direction of the axis 201. As explained above, the rotor 210 can be configured to rotate about the axis 201 and communicate a first fluid through the first side surface 211 of the rotor 210 and a second fluid through the second side surface 212 of the rotor 210.

The pressure exchanger 200 can include a plurality of flow dividers having a non-tubular shape. For example, the flow dividers can have a substantially flat shape (e.g., a plate shape). FIG. 3 illustrates three flow dividers or plates 203, 204, and 205, for example, but the pressure exchanger 200 can include more or less flow dividers in other implementations. In some implementations, each of the rotor ducts 202 can include one or more flow dividers therein that extend through each rotor ducts 202.

The flow divider 203 represents a first insertion position in which the flow divider 203 is partially inserted into one of the rotor ducts 202. The flow divider 204 represents a second insertion position in which the flow divider 204 is further pushed into one of the rotor ducts 202 and makes surface alignment or flush with the first side surface 211. In some cases, the second insertion position may be a final position of the flow divider 204. In some implementations, the second insertion position is not a final position of the flow divider 204.

For example, the flow divider 205 represents a third insertion position in which the flow divider 205 is further pushed into one of the rotor ducts 202 and its end positioned slightly below or recessed relative to the first side surface 211. That is, the flow divider 205 has a first axial end surface that is spaced apart from and recessed relative to the first side surface 211 in the axial direction. The flow divider 205 can further include a second axial end surface that is spaced apart from and recessed relative to the second side surface 212 of the rotor 210 in the axial direction.

In some examples, the third insertion position of the flow divider 205 can be the final position of each of the flow dividers to avoid any mechanical contact or interference with the opposing end cover 220 or 230 (see FIG. 2). Thus, the rotor 210 can rotate relative to the end covers 220 and 230 without interference with the flow dividers in their final positions inside the rotor ducts 202. For instance, an axial length of the flow divider 205 can be less than a rotor length ("L") of the rotor 210 in the axial direction such that the axial ends of the flow divider 205 are recessed relative to the first side surface 211 and the second side surface 212, respectively.

In some implementations, where the rotor 210 is made of ceramic as described above, the flow dividers can be made of plastic or composite materials. The flow dividers can be held in place by friction force against inner surfaces of the rotor ducts 202, and, in some examples, aided with an adhesive or glue.

The flow divider can partition each rotor duct 202 into multiple equal resistance flow elements or paths without any sealing or structural support function. The flow dividers 203, 204, and 205 can reduce an aspect ratio of the flow elements to thereby reduce mixing of the fluid streams inside the rotor duct 202 and increase a utilization of the rotor space without increasing a rotation speed of the rotor 210.

For example, the flow divider 205 can define an aspect ratio of two flow paths defined in the rotor duct 202. Specifically, the aspect ratio can be a ratio of a width of one flow path in a radial direction with respect to an axial length of the flow path in the axial direction. The width can be less than or equal to a diameter of one rotor duct 202, and the length can be less than or equal to the rotor length L. In some examples, each of the plurality of flow paths can have an equal width or define an equal cross-sectional area. In addition, each of the plurality of flow paths can have an equal axial length to thereby define an equal aspect ratio for the plurality of flow paths.

Figure 4A:
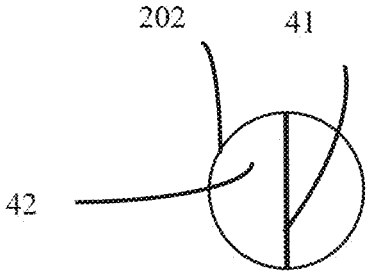
FIGS. 4A to 4C are views showing examples of flow divider structures.
Figure 4B:
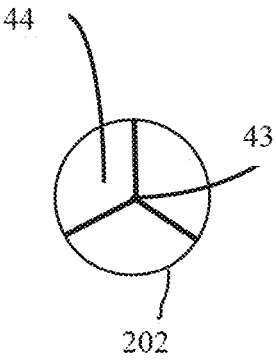
Figure 4C:
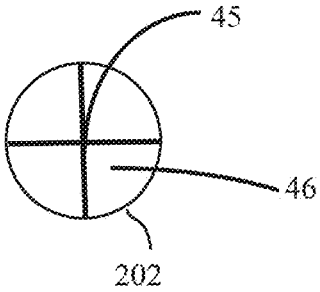

FIGS. 4A to 4C are views showing various examples of flow divider structures disposed in a rotor duct.

FIG. 4A illustrates an example of a flow divider including a single wall or plate 41 that divides the rotor duct 202 into two equal resistance flow paths 42. In this example, each flow path 42 can have an equal cross-section area, for example, a half of a circle area defined by the rotor duct 202. A radial width of each flow path 42 can be between a radius and a diameter of the circle area defined by the rotor duct 202. In some cases, the aspect ratio can be determined based on an effective diameter of a virtual circle that has the same area as the cross-section area of one flow path. For example, referring to FIG. 4A, the effective diameter of the virtual circle can be $1/\sqrt{2}$ of the diameter of the circle area defined by the rotor duct 202. In some implementations, each of flow path 42 can apply an equal flow resistance to the fluid streams such that the fluid streams flow with an equal flow velocity when an equal pressure difference is applied to axial ends of each flow path 42. This is one of important conditions to maximize flow capacity without increasing mixing between the fluid streams in the rotor duct 202.

FIG. 4B illustrates an example of a flow divider having a hub structure including three plates or walls 43 that define three equal resistance flow paths 44. In some examples, the flow divider structure can be symmetrical with respect to a diameter of the circle area defined by the rotor duct 202. In the example shown in FIG. 4B, the effective diameter of the virtual circle can be $1/\sqrt{3}$ of the diameter of the circle area defined by the rotor duct 202 because each of the pie-shaped areas has ⅓ of the circle area defined by the rotor duct 202. The effective diameter of the virtual circle can be used to determine the aspect ratio of the flow paths 44. In some implementations, each of flow path 44 can apply an equal flow resistance to the fluid streams such that the flow streams flow with an equal flow velocity when an equal pressure difference is applied to axial ends of each flow path 44.

In some examples, the flow divider structure may not be symmetrical but rather be adapted to the actual shape of the rotor duct 202. For instance, the rotor duct 202 can have a non-circular shape, and the flow dividers can be arranged to define a plurality of flow paths that have an equal cross-sectional area regardless of the shape or symmetricity of each of the plurality of flow paths. In some implementations, the flow divider structure can include an increased number of flow dividers. For example, one rotor duct 202 can include a flow divider that includes three or more flow divider portions or walls therein (e.g., FIGS. 4B and 4C).

FIG. 4C illustrates an example of a flow divider including four plates or walls 45 that define four equal resistance flow paths 46. In the example shown in FIG. 4C, the effective diameter can be ½ of the diameter of the circle area defined by the rotor duct 202 because each of the pie-shaped area has ¼ of the circle area defined by the rotor duct 202. The effective diameter of the virtual circle can be used to determine the aspect ratio of the flow paths 46. In some implementations, each flow path 46 can apply an equal flow resistance to the fluid streams such that the fluid streams flow with an equal flow velocity when an equal pressure difference is applied to axial ends of each flow path 46.

Figure 5:
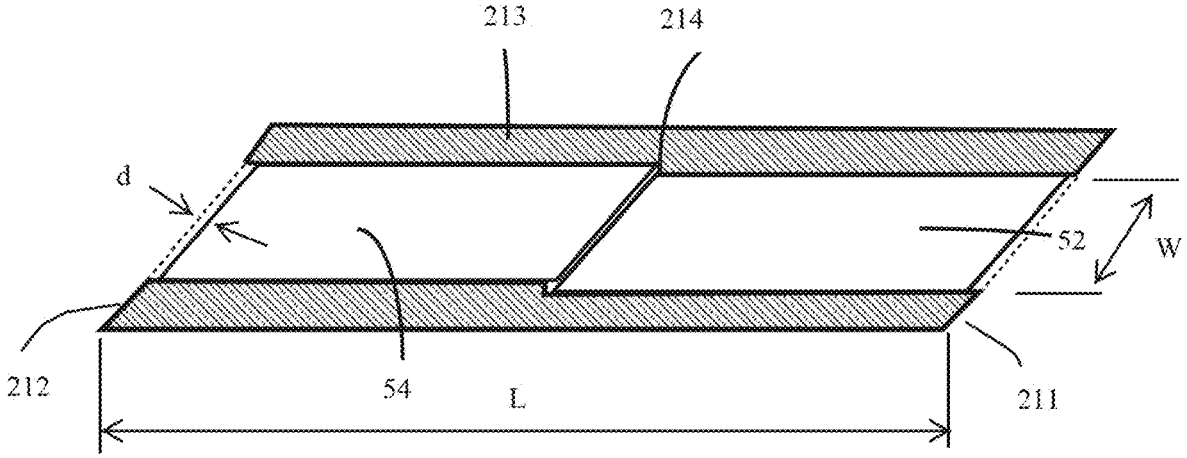
FIG. 5 is a cross-sectional view showing an example of a rotor duct including split flow dividers that accommodate duct manufacturing offsets.

FIG. 5 is a cross-sectional view showing an example of a rotor duct including split flow dividers that accommodate duct manufacturing offsets. For examples, FIG. 5 illustrates a cross-section area of a rotor duct 213 including a step portion 214 that can be generated from machining of the rotor duct 213. For example, the step portion 214 can be generated at a position halfway from both ends of the rotor duct 213.

In some examples, a misalignment of a boring process of the rotor duct 213 may result in the step portion 214. In particular, the boring process can be performed from the first side surface 211 toward the second side surface 212 and then performed from the second side surface 212 toward the first side surface 211. In some cases, the boring process can be simultaneously performed from the first side surface 211 and the second side surface 212 toward the opposing side surfaces. The step portion 214 can be generated if the boring process from the side surfaces are performed along two axes that are slightly offset from each other.

In some examples, the misalignment of the boring process can vary from one rotor duct to another. For example, a location of the step portion 214 relative to the side surface 211 and 212 can vary from one rotor duct to another. In some cases, a step depth of the step portion 214 can vary, as well, from one rotor duct to another.

In some implementations, the flow divider can include two or more separate flow dividers 52 and 54 inserted from each end of the rotor duct 213 to accommodate the misalignment or variation of the boring process. For example, the rotor duct 213 includes the step portion 214, a first rotor portion that extends from the first side surface 211 to the step portion 214, and a second rotor portion that extends from the second side surface 212 to the step portion 214. The first flow divider 52 can be located in and extend along the first rotor portion (e.g., the right part of the step portion 214 in FIG. 5), and the first flow divider 52 has a first inner end that faces the step portion 214. The second flow divider 54 can be located in and extend along the second rotor portion (e.g., the left part of the step portion 214 in FIG. 5), and the second flow divider 54 has a second inner end that faces the first inner end and the step portion 214.

In some implementations, an outer end of at least one of the first flow divider 52 or the second flow divider 54 may be spaced apart from the corresponding side surface 211 or 212. For example, the outer end of each of the first flow divider 52 and the second flow divider 54 can be recessed relative to the corresponding side surfaces 211 and 212 by a distance "d." In some cases, the aspect ratio can be defined as D/k(L−2d), where D denotes an inner diameter of the rotor duct 213, and k denotes an adjustment coefficient according to an effect diameter. The effective diameter can be determined by a number of flow paths defined by the flow divider (e.g., $k=\sqrt{N}$, where N is a number of flow paths in one rotor duct).

Referring to FIG. 5, the aspect ratio can be proportional to a width ("W") of the first flow divider 52 or the second flow divider 54 in the radial direction, and the aspect ratio can be inversely proportional to a sum of axial lengths of the first flow divider and the second flow divider. For example, the sum of axial lengths of the first flow divider 52 and the second flow divider 54 may be less than or equal to the distance L between the first side surface 211 and the second side surface 212. The distance L can be defined as the rotor length L (see FIG. 3).

In some cases, the width W of the first flow divider 52 can be equal to the width of the second flow divider 54, and the axial length of the first flow divider 52 can be equal to the axial length of the second flow divider 54. For example, the axial length of the first flow divider 52 and the second flow divider 54 can be a half of (L−2d).

In some implementations, the width (W1) of the first flow divider 52 can be different from the width (W2) of the second flow divider 54, and the axial length (L1) of the first flow divider 52 can different from the axial length (L2) of the second flow divider 54 to accommodate variation in the boring process of each rotor duct. In some examples, the first flow divider 52 can be recessed by d1 from the side surface 211, and the second flow divider 54 can be recessed by d2 from the side surface 212. That is, the separate flow dividers 52 and 54 can have structure for accommodating manufacturing offsets to thereby provide strong friction force to keep the structure from moving, and wearing of the flow dividers 52 and 54 and the rotor duct 213 can be reduced.

All examples described herein are merely to describe the present disclosure in greater detail. Therefore, it should be understood that the scope of the present disclosure is not limited to the example implementations described above or by the use of such terms unless limited by the appended claims. Also, it should be apparent to those skilled in the art that various alterations, substitutions, and modifications may be made within the scope of the appended claims or equivalents thereof.

What is claimed is:

1. A pressure exchanger comprising:

a rotor configured to rotate about an axis, the rotor defining a plurality of rotor ducts extending parallel to the axis, each rotor duct extending between a first side surface and a second side surface of the rotor that are spaced apart from each other in an axial direction, wherein the rotor is configured to communicate a first fluid through the first side surface of the rotor and to communicate a second fluid through the second side surface of the rotor; and a flow divider that has a substantially flat shape and that is located in at least one rotor duct among the plurality of rotor ducts, the flow divider being inserted into the at least one rotor duct and in contact with an inner surface of the at least one rotor duct, and partitioning the at least one rotor duct into a plurality of flow paths that are configured to communicate at least one of the first fluid or the second fluid, wherein the flow divider defines an aspect ratio of each of the plurality of flow paths, the aspect ratio being a ratio of a width of one of the plurality of flow paths in a radial direction with respect to an axial length of the one of the plurality of flow paths in the axial direction, wherein a cross-section of the at least one rotor duct has a circle shape having a center, wherein the flow divider passes through the center, and wherein the plurality of flow paths inside the at least one rotor duct are symmetrical with respect to a diameter line of the circle shape passing through the center.

2. The pressure exchanger of claim 1, wherein each of the plurality of flow paths has an equal aspect ratio.

3. The pressure exchanger of claim 2, wherein each of the plurality of flow paths has an equal cross-sectional area.

4. The pressure exchanger of claim 3, wherein each of the plurality of flow paths has the same width and the same axial length.

5. The pressure exchanger of claim 1, wherein an axial length of the flow divider is less than a rotor length of the rotor in the axial direction.

6. The pressure exchanger of claim 5, wherein the rotor length is greater than the axial length of each of the plurality of flow paths in the axial direction, and wherein the flow divider comprises:

a first axial end surface that is spaced apart from and recessed relative to the first side surface of the rotor in the axial direction; and a second axial end surface that is spaced apart from and recessed relative to the second side surface of the rotor in the axial direction.

7. The pressure exchanger of claim 1, further comprising a plurality of flow dividers including the flow divider, the plurality of flow dividers being located inside the plurality of rotor ducts, respectively.

8. The pressure exchanger of claim 7, wherein the plurality of flow dividers comprise a first and second flow dividers that are located inside the at least one rotor duct and that define three or more flow paths in the at least one rotor duct.

9. The pressure exchanger of claim 8, wherein the first flow divider comprises a first plate, and the second flow divider comprises a second plate that intersects the first plate.

10. The pressure exchanger of claim 9, wherein an axial length of each of the first plate and the second plate is equal to the axial length of the plurality of flow paths in the axial direction.

11. The pressure exchanger of claim 10, wherein the plurality of flow dividers further comprise a third flow divider located inside the at least one rotor duct, the third flow divider including a third plate that intersects the first flow divider and the second flow divider, and wherein a radial width of the third plate and the radial width of each of the first plate and the second plate are equal to a radius of the at least one rotor duct.

12. The pressure exchanger of claim 1, wherein the at least one rotor duct comprises:

a step portion that is recessed from an inner circumferential surface of the at least one rotor duct of the plurality of rotor ducts;

a first rotor portion that extends from the first side surface of the rotor to the step portion; and a second rotor portion that extends from the second side surface of the rotor to the step portion, and wherein the flow divider is one of a plurality of flow dividers that are located in the first rotor portion and the second rotor portion.

13. The pressure exchanger of claim 12, wherein the plurality of flow dividers comprise:

a first flow divider that is inserted into the at least one rotor duct through the first side surface of the rotor and extends along the first rotor portion, the first flow divider having a first inner end that faces the step portion; and a second flow divider that is inserted into the at least one rotor duct through the second side surface of the rotor and extends along the second rotor portion, the second flow divider having a second inner end that overlaps with the first inner end and the step portion.

14. The pressure exchanger of claim 13, wherein the aspect ratio is defined by a width of the first flow divider or the second flow divider in the radial direction with respect to a sum of axial lengths of the first flow divider and the second flow divider.

15. The pressure exchanger of claim 14, wherein the width of the first flow divider is different from the width of the second flow divider, and the axial length of the first flow divider is different from the axial length of the second flow divider.

16. The pressure exchanger of claim 1, wherein the rotor is made of ceramic, and wherein the flow divider is made of a plastic material.

17. The pressure exchanger of claim 16, wherein the flow divider is coupled to the inner surface of the at least one rotor duct by friction without an adhesive.

18. The pressure exchanger of claim 16, wherein the flow divider is coupled to the inner surface of the at least one rotor duct by friction and with an adhesive.

19. The pressure exchanger of claim 1, further comprising:

a first end cover located at the first side surface of the rotor, the first end cover defining a first pair of apertures configured to communicate the first fluid; and a second end cover located at the second side surface of the rotor, the second end cover defining a second pair of apertures configured to communicate the second fluid, wherein the flow divider comprises:

a first end that faces the first end cover and is spaced apart from the first end cover in the axial direction, and a second end that faces the second end cover and is spaced apart from the second end cover in the axial direction.

20. The pressure exchanger of claim 1, wherein a duct length of each of the plurality of rotor ducts in the axial direction is greater than the axial length of the plurality of flow paths.

* * * * *